US008509666B2

(12) United States Patent
Kobayashi et al.

(10) Patent No.: US 8,509,666 B2
(45) Date of Patent: Aug. 13, 2013

(54) FIXING DEVICE AND IMAGE FORMING APPARATUS

(75) Inventors: Yasuyuki Kobayashi, Ebina (JP); Kenji Kanai, Ebina (JP); Masakatsu Eda, Ebina (JP); Norio Ogawahara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 12/941,788

(22) Filed: Nov. 8, 2010

(65) Prior Publication Data

US 2011/0236082 A1 Sep. 29, 2011

(30) Foreign Application Priority Data

Mar. 29, 2010 (JP) ..... 2010-075267

(51) Int. Cl.
*G03G 15/20* (2006.01)

(52) U.S. Cl.
USPC ..... 399/327; 399/122; 399/320; 399/400

(58) Field of Classification Search
USPC ..... 399/327, 122, 320.4
See application file for complete search history.

(56) References Cited

U.S. PATENT DOCUMENTS

| | | | | |
|---|---|---|---|---|
| 7,187,898 | B2 * | 3/2007 | Katayanagi et al. | 399/327 |
| 7,778,564 | B2 | 8/2010 | Sone et al. | |
| 2008/0050154 | A1 * | 2/2008 | Ide et al. | 399/323 |
| 2008/0219722 | A1 | 9/2008 | Sone et al. | |
| 2008/0226315 | A1 * | 9/2008 | Yamanaka et al. | 399/45 |

FOREIGN PATENT DOCUMENTS

| | | | |
|---|---|---|---|
| JP | 10-097150 | A | 4/1998 |
| JP | 10-036025 | A1 | 10/1998 |
| JP | 2000-227732 | A | 8/2000 |
| JP | 2004-198537 | A | 7/2004 |
| JP | 2008-139333 | A | 6/2008 |
| JP | 2008225471 | A1 | 9/2008 |
| JP | 2009-168880 | A | 7/2009 |

OTHER PUBLICATIONS

Communication from Japanese Patent Office Mailed Jul. 24, 2012 in corresponding Japanese Patent Application No. 2010-075267.
Japanese Office Action issued Oct. 2, 2012 in corresponding Japanese Patent Application No. 2010-075267.

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A fixing device includes: a first rotating member; a second rotating member that extends along the first rotating member, sandwiches a recording medium with a toner image formed thereon between the first and second rotating members, rotates together with the first rotating member, and heats the recording medium to fix the toner image on the recording medium; a heating device whose circumferential surface circularly moves while contacting an external circumferential surface of the second rotating member, and the heating device heats the second rotating member; a temperature detecting device disposed to face the external circumferential surface of the second rotating member without contacting the external circumferential surface to detect a temperature thereof; and a cleaning device cleaning the circumferential surface of the heating device and disposed between the heating device and the temperature detecting device along the surface of the second rotating member.

11 Claims, 7 Drawing Sheets

FIXING DEVICE AND IMAGE FORMING APPARATUS

CROSS-REFERENCE TO RELATED APPLICATION

This application is based on and claims priority under 35 USC 119 from Japanese Patent Application No. 2010-075267, filed Mar. 29, 2010.

BACKGROUND (i) Technical Field

The present invention relates to a fixing device and an image forming apparatus.

(ii) Related Art

As a fixing device that is included in an image forming apparatus and fixes a toner on a recording medium, a fixing device is known that includes a fixing roller and a pressing roller and further includes an external heating unit that is provided to be set in contact with the circumferential surface of the fixing roller from the outside of the fixing roller and heats the circumferential surface.

SUMMARY

An image forming apparatus according to claim 1 includes:

a toner image forming unit that forms a toner image on a recording medium;

a first rotating member that rotates;

a second rotating member that extends side by side with the first rotating member, sandwiches the recording medium on which the toner image is formed thereon by the toner image forming unit between the second rotating member and the first rotating member, rotates together with the first rotating member, and heats the recording medium to fix the toner image on the recording medium;

a heating device whose circumferential surface circularly moves while contacting an external circumferential surface of the second rotating member, the heating device heating the second rotating member;

a temperature detecting device that is disposed to face the external circumferential surface of the second rotating member without contacting the external circumferential surface and detects temperature of the external circumferential surface; and a cleaning device that cleans the circumferential surface of the heating device, and is disposed between the heating device and the temperature detecting device along the surface of the second rotating member.

BRIEF DESCRIPTION OF THE DRAWINGS

Exemplary embodiments of the present invention will be described in detail based on the following figures, wherein.

DETAILED DESCRIPTION

Exemplary embodiments of the present invention are explained below with reference to the accompanying drawings.

Figure 1:
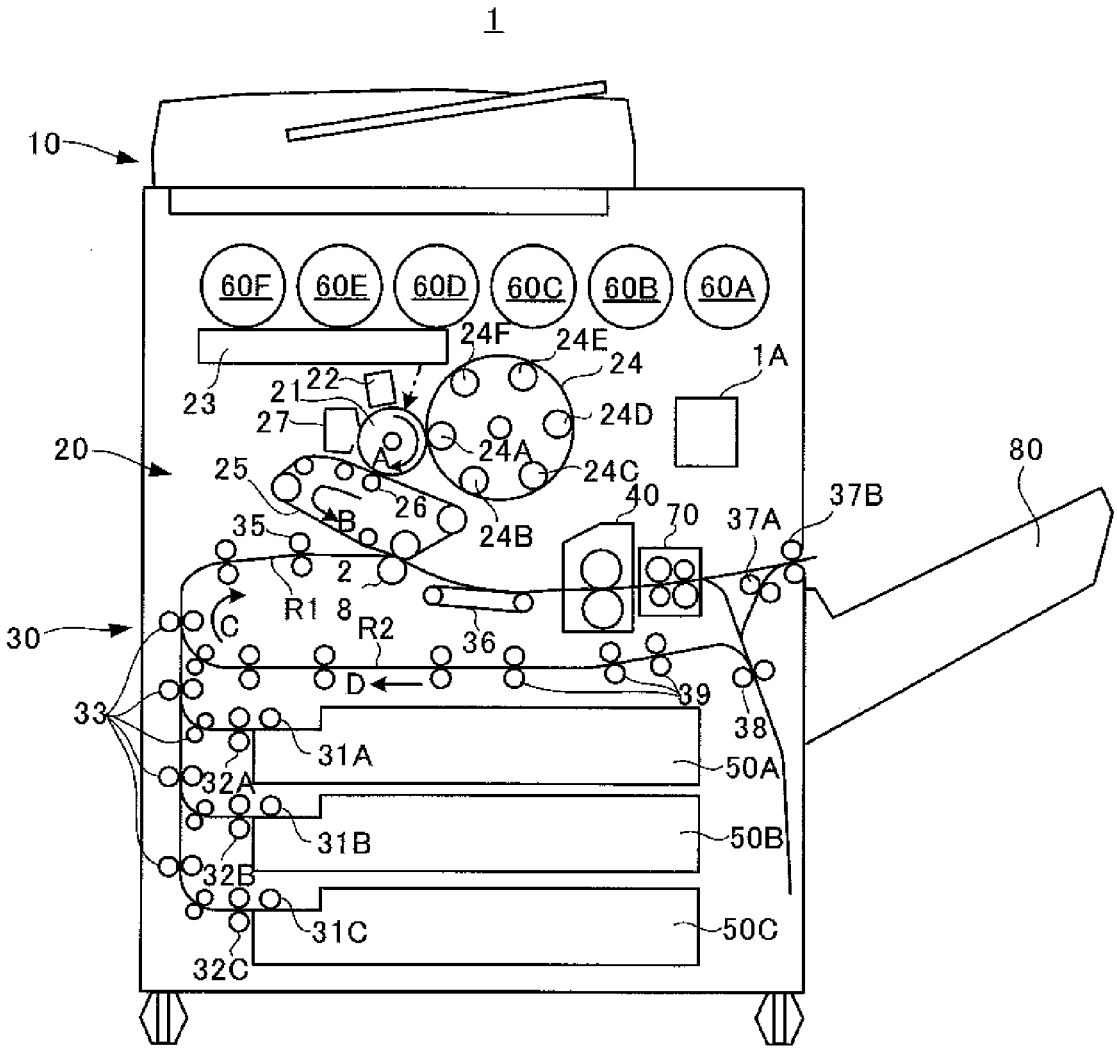
FIG. 1 is a diagram illustrating a schematic configuration of a copying machine as a first embodiment of an image forming apparatus according to the present invention.

FIG. 1 is a diagram illustrating a schematic configuration of a copying machine as a first embodiment of an image forming apparatus according to the present invention.

A copying machine 1 illustrated in FIG. 1 includes an image reading unit 10 that reads an image from an original document, a toner image forming unit 20 that forms a toner image on a sheet, a sheet conveying unit 30 that conveys the sheet, a fixing device 40 that fixes a toner on the sheet, and a control unit 1A that controls the units of the copying machine 1. The copying machine 1 also includes sheet containing units 50A, 50B, and 50C that contain sheets and toner containing devices 60A, 60B, 60C, 60D, 60E, and 60F that contain toners of six colors used to form of an image. The sheet conveying unit 30 takes out a sheet from the sheet containing units 50A, 50B, and 50C and conveys the sheet through a conveying path R1 via the toner image forming unit 20. The image reading unit 10 reads an image from an original document and generates image data. The toner image forming unit 20 forms, based on the image data generated by the image reading unit 10, an image on the sheet conveyed by the sheet conveying unit 30.

The toner image forming unit 20 includes: a photosensitive drum 21 on the surface of which an electrostatic latent image and a toner image are formed and that rotates in an arrow A direction in the figure; a charging device 22 that charges the photosensitive drum 21; an exposing unit 23 to which image data is inputted and which emits exposure light modulated based on the image data on the photosensitive drum 21 and forms an electrostatic latent image; a developing unit 24 that applies a toner to the electrostatic latent image to form a toner image; an intermediate transfer belt 25 that comes into contact with the photosensitive drum 21 and circularly moves in an arrow B direction in the figure; a primary transfer roll 26 that primarily transfers the toner image formed on the photosensitive drum 21 onto the intermediate transfer belt 25; a photosensitive cleaning device 27 that cleans the photosensitive drum 21 after the primary transfer; and a secondary transfer device 28 that secondarily transfers the toner image, which is primarily transferred onto the intermediate transfer belt 25, onto a sheet conveyed by the sheet conveying unit 30 from sheet containing units 50A, 50B, and 50C. The fixing device 40 heats and presses the toner image transferred onto the sheet to thereby fix the toner image on the sheet. The copying machine 1 also includes a curl reforming device 70 that reforms a curl of the sheet having the toner image fixed thereon and a stacking tray 80 in which the sheet having an image formed thereon is stacked.

In the developing unit 24, six developing devices 24A, 24B, 24C, 24D, 24E, and 24F respectively corresponding to six colors including four colors CMYK and two spot colors are incorporated. In each of the developing devices 24A to 24F, two-component developers including toners of the respective colors and a carrier are contained. The developing unit 24 sequentially rotates 60 degrees at a time, whereby development by the toners of CMYK and the spot colors is developed and toner images of the colors are formed. The toner images of the colors are superimposed one on top of another when being transferred onto the intermediate transfer belt 25 by the primary transfer roll 26 and a full-color toner image is formed. The full-color toner image is transferred onto a sheet by the secondary transfer device 28. The toners of the respective colors are supplied to the six developing devices 24A to 24F from the toner containing devices 60A to 60F.

The sheet conveying unit 30 conveys a sheet along the conveying path R1 and a front and rear reversing path R2. The sheet conveying unit 30 includes taking-out rolls 31A, 31B, and 31C that take out the sheet from the sheet storing devices 50A, 50B, and 50C, sorting rolls 32A, 32B, and 32C that handle the sheet, a conveying roll 33 that conveys the handled sheet, a registration roll 35 that feeds the sheet into the secondary transfer device 28 according to timing when the secondary transfer device 28 transfers a toner image, a belt conveying device 36 that conveys the sheet from the secondary transfer device 28 to the fixing device 40 while absorbing the sheet, discharging rolls 37A and 37B that discharge the sheet to the outside of the copying machine 1, a switching and conveying roll 38 that switches a direction of the conveyance of the sheet and conveys the sheet, and a duplex conveyance roll 39 that conveys, for duplex printing, the sheet along the front and rear reversing path R2.

The sheets contained in the sheet storing devices 50A to 50C are taken out by the taking-out rolls 31A to 31C and sorted by the sorting rolls 32A to 32C. Each of the sorted sheets is conveyed by the conveying roll 33 on the conveying path R1 in an arrow C direction in the figure. Thereafter, the sheet is fed into the secondary transfer device 28 by the registration roll 35 and the toner image is transferred onto the sheet. The sheet is conveyed to the fixing device 40 by the belt conveying device 36 and a toner is fixed on the sheet. Thereafter, a curl of the sheet is reformed by the curl reforming device 70. The sheet is discharged by the discharging rolls 37A and 37B and stacked on the stacking tray 80.

When the duplex printing is executed in the copying machine 1, the sheet conveying unit 30 conveys a sheet along the front and rear reversing path R2 branching from the conveying path R1 and returning to the conveying path R1 and returns traveling of the sheet halfway in the front and rear reversing path R2 to thereby reverse the front and rear surfaces of the sheet. More specifically, the sheet having passed through the curl reforming device 70 is conveyed in the reverse direction by switching of a conveying direction by the switching and conveying roll 38 while being conveyed by the switching and conveying roll 38. Subsequently, the sheet is conveyed in an arrow D direction in the figure along the front and rear reversing path R2 by the duplex conveyance roll 39. The sheet conveyed through the front and rear reversing path R2 returns to the conveying path R1 and passes through the conveying roll 33 and the registration roll 35 again. The toner image is transferred by the secondary transfer device 28 onto the rear surface, i.e., a surface on which the toner image is not transferred yet. The control unit 1A controls the operations of the units of the copying machine 1.

Figure 2:
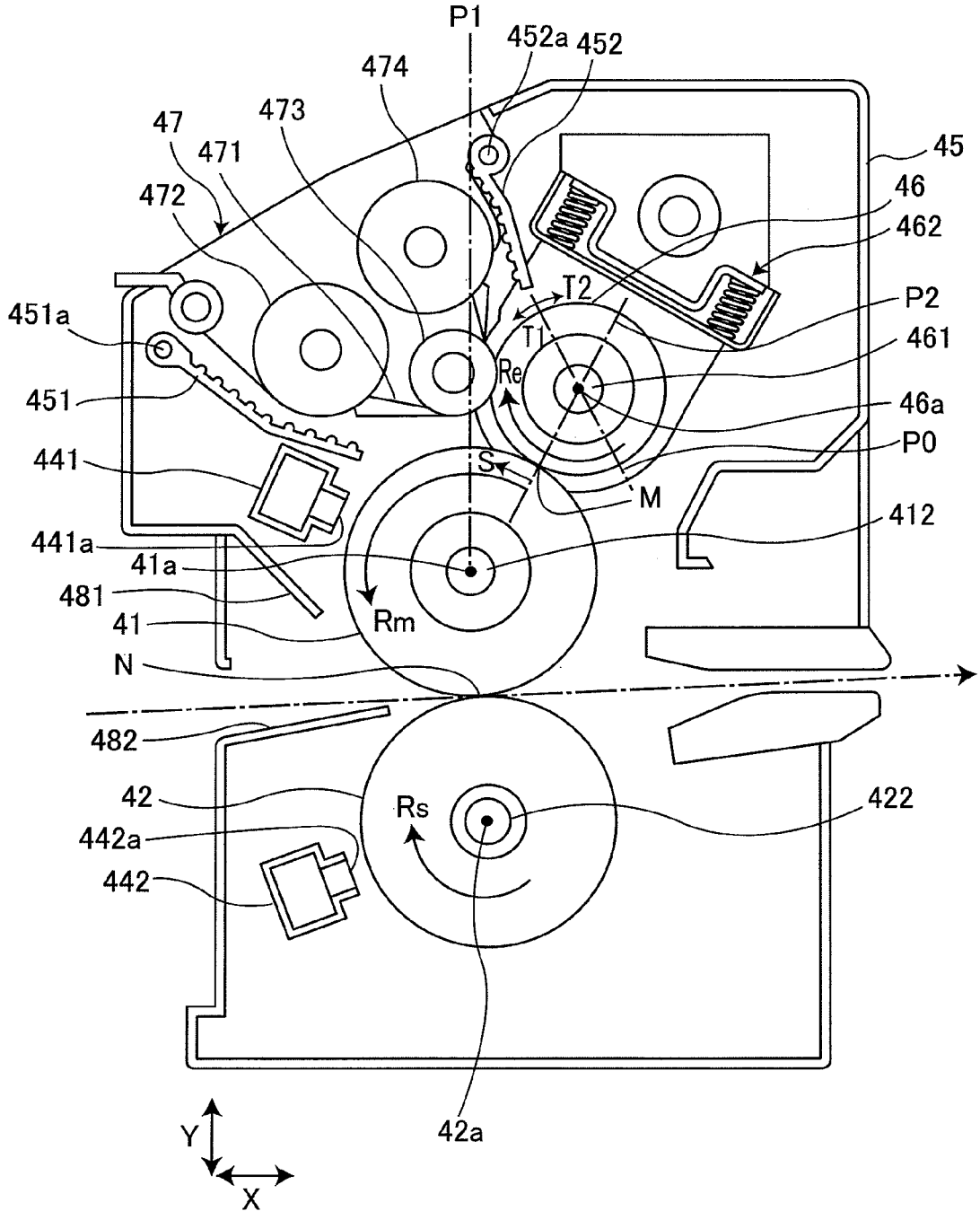
FIG. 2 is a longitudinal sectional view illustrating an internal configuration of a fixing device illustrated in FIG. 1.
Figure 3:
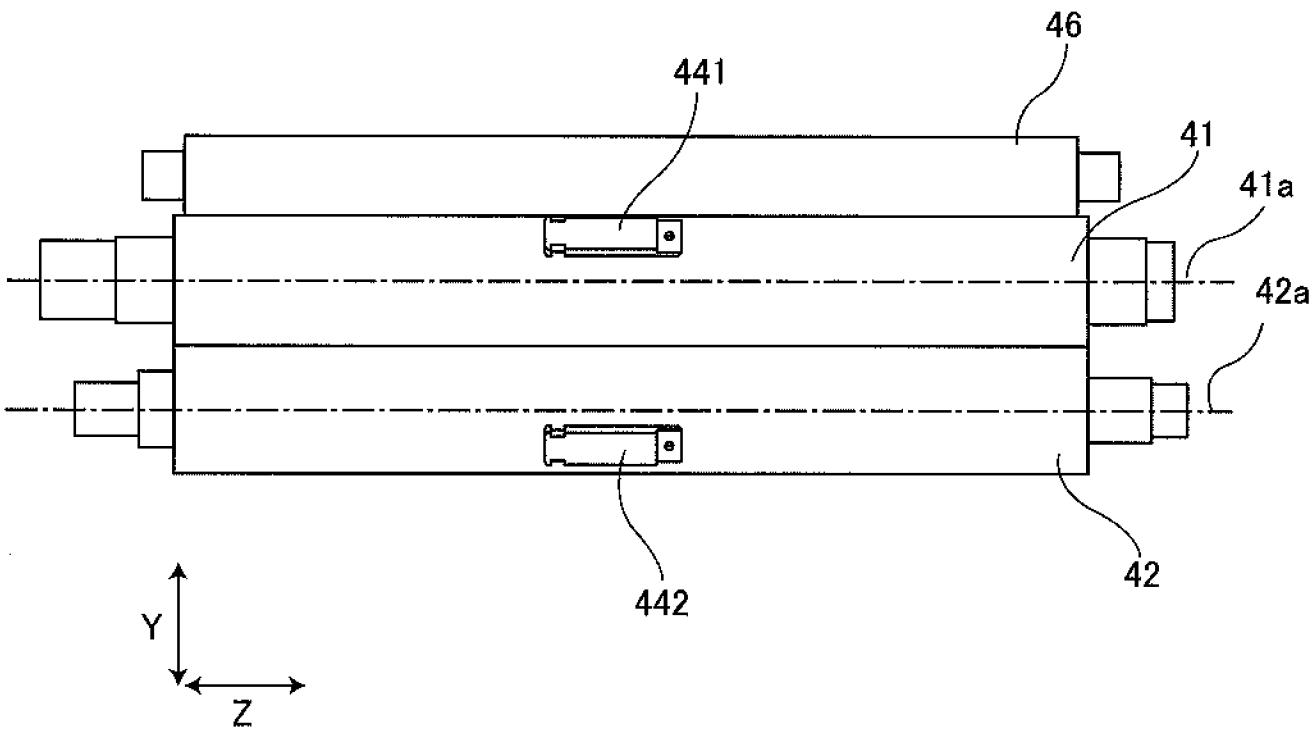
FIG. 3 is a diagram illustrating the arrangement of a heating roll, a pressing roll, an external heating roll, and a temperature detecting device included in the fixing device.

FIG. 2 is a longitudinal sectional view of an internal configuration of the fixing device illustrated in FIG. 1. FIG. 3 is a diagram of the arrangement of a heating roll, a pressing roll, an external heating roll, and a temperature detecting device included in the fixing device.

The fixing device 40 illustrated in FIGS. 2 and 3 includes a heating roll 41, a pressing roll 42, and an external heating roll 46. The heating roll 41, the pressing roll 42, and the external heating roll 46 are respectively cylindrical rotating members extending side by side along rotation centers 41*a*, 42*a*, and 46*a*. The heating roll 41 is arranged on the pressing roll 42. The circumferential surfaces of the heating roll 41 and the pressing roll 42 are in contact with each other. The pressing roll 42 is pressed against the heating roll 41. A sandwiching region N to sandwich a sheet is formed between the heating roll 41 and the pressing roll 42. The heating roll 41 and the pressing roll 42 have not-illustrated elastic layers of rubber. The elastic layers are elastically deformed by pressing force and surfaces for nipping the sheet is formed in the nip region N. In the heating roll 41 and the pressing roll 42, halogen lamps 412 and 422 as heat sources are disposed in cylindrical insides, respectively.

Driving force is transmitted to the heating roll 41 from a not-illustrated driving motor. The heating roll 41 rotates in an arrow Rm direction around the rotation center 41*a*. The pressing roll 42 receives the rotation of the heating roll 41, which is in contact with the pressing roll 42, and rotates in an arrow Rs direction around the rotation center 42*a*. The sheet fed into the fixing device 40 is sandwiched by the heating roll 41 and the pressing roll 42 in the sandwiching region N and conveyed. The toner image on the sheet at this point is brought into contact with the heating roll 41 to be heated. Pressure by a pressing force by which the pressing roll 42 is pressed against the heating roll 41 is applied to the toner image. The toner image is fixed on the sheet.

The external heating roll 46 comes into contact with the circumferential surface of the heating roll 41 and heats the heating roll 41 from the outer side. The external heating roll 46 is pressed against the heating roll 41 by a pressing adjusting unit 462 and rotates in an arrow Re direction around the rotation center 46*a*. As in the heating roll 41, in the external heating roll 46, a halogen lamp 461 as a heat source is disposed on the inside.

When the sheet passes between the heating roll 41 and the pressing roll 42, heat is absorbed by the sheet and the temperature of the circumferential surface of the heating roll 41 drops. The halogen lamp 412 is disposed in the heating roll 41. Heat from the halogen lamp 412 conducts through the elastic layer of rubber and reaches the circumferential surface. Heat is supplied to the circumferential surface of the heating roll 41 from the external heating roll 46, whereby the temperature of the circumferential surface of the heating roll 41 quickly recovers.

The fixing device 40 includes a heating roll temperature sensor 441 that detects the temperature of the circumferential surface of the heating roll 41 and a pressing roll temperature sensor 442 that detects the temperature of the circumferential surface of the pressing roll 42. The heating roll temperature sensor 441 and the pressing roll temperature sensor 442 are infrared temperature sensors of a non-contact type. The heating roll temperature sensor 441 and the pressing roll temperature sensor 442 detect temperature with infrared rays incident on detecting sections 441*a* and 442*a* of the sensors from an object. The heating roll temperature sensor 441 is arranged to be opposed to the circumferential surface of the heating roll 41. The pressing roll temperature sensor 442 are arranged to be opposed to the circumferential surface of the pressing roll 42. The heating roll temperature sensor 441 faces the detecting section 441*a* to the circumferential surface of the heating roll 41. The pressing roll temperature sensor 442 faces the detecting section 442*a* to the circumferential surface of the pressing roll 42.

The heating roll temperature sensor 441 detects the temperature of the circumferential surface of the heating roll 41 in a non-contact manner and supplies a detection result to the control unit 1A (see FIG. 1) as an electric signal. The control unit 1A adjusts, based on a value of the read electric signal, an amount of electric power to be supplied to the halogen lamp 412 of the heating roll 41 to control the temperature of the circumferential surface of the heating roll 41 to temperature set in advance for optimizing a fixing ability of the fixing device 40. The same control is applied to the pressing roll 42. The temperature of the external heating roll 46 is controlled based on a detection result of a not-illustrated temperature sensor of a non-contact type.

When attention is paid to one point on the circumferential surface of the heating roll 41, according to the rotation of the heating roll 41, after passing a contact position M where the heating roll 41 is in contact with the external heating roll 46, the point passes the front of the heating roll temperature sensor 441 and, thereafter, comes into contact with the pressing roll 42 and the sheet. The heating roll 41, the pressing roll 42, the external heating roll 46, and the temperature sensors 441 and 442 are housed in a housing 45 of the fixing device 40. Guiding members 481 and 482 that guide the sheet to the sandwiching region N are also provided in the fixing device 40. The heating roll temperature sensor 441 is arranged right above the guiding member 481 arranged on the upper side of the guiding members 481 and 482. A positional relation between the heating roll temperature sensor 441 and the other members is explained later.

The pressing roll 42 is equivalent to an example of the first rotating member in the present invention. The heating roll 41 is equivalent to an example of the second rotating member in the present invention. The external heating roll 46 is equivalent to an example of the heating device in the present invention. The heating roll temperature sensor 441 is equivalent to an example of the temperature detecting device in the present invention.

The fixing device 40 includes a cleaning device 47 that wipes and cleans the circumferential surface of the external heating roll 46. The cleaning device 47 is arranged detachably with the fixing device 40. The cleaning device 47 includes a web 471, a feeding roll 474, a pressing roll 473, and a winding roll 472. The web 471 is an elongated belt made of fiber such as nonwoven fabric and wound around the feeding roll 474. The web 471 drawn out from the feeding roll 471 is laid over the pressing roll 473 and wound by the winding roll 472. The pressing roll 473 presses the web 471 against the circumferential surface of the external heating roll 46. The winding roll 472 is driven to rotate by a not-illustrated motor, whereby the web 471 is drawn out from the feeding roll 474, pressed against the external heating roll 46 by the pressing roll 473 to wipe the circumferential surface of the external heating roll 46, and wound by the winding roll 472. A toner adhering to the heating roll 41 and attracted by the external heating roll 46 is wiped and cleaned by the web 471. When the web 471 is entirely drawn out from the feeding roll 474, the web 471 is regarded as already used. An operator replaces the cleaning device 47 together with the used web 471.

Figure 4:
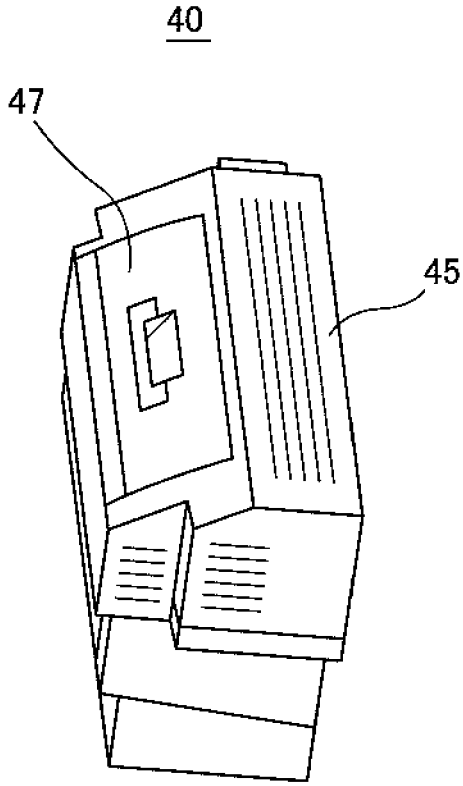
FIG. 4 is a perspective view illustrating the fixing device to which a cleaning device is attached.
Figure 5:
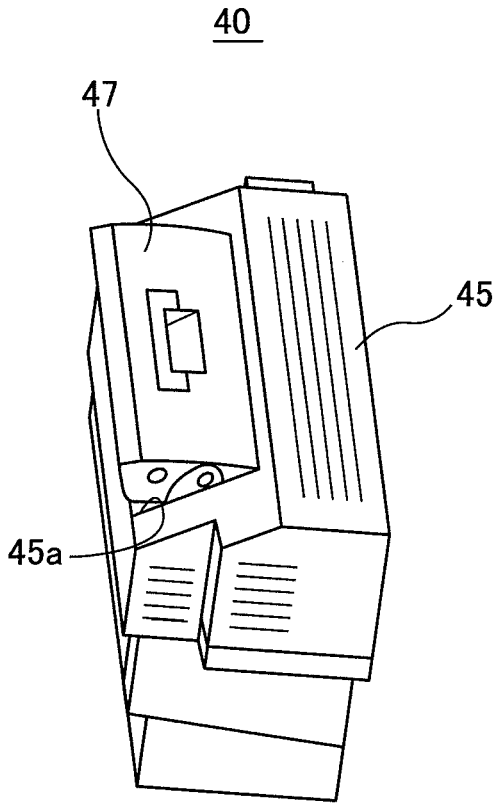
FIG. 5 is a perspective view illustrating the fixing device from which the cleaning device is being removed.
Figure 6:
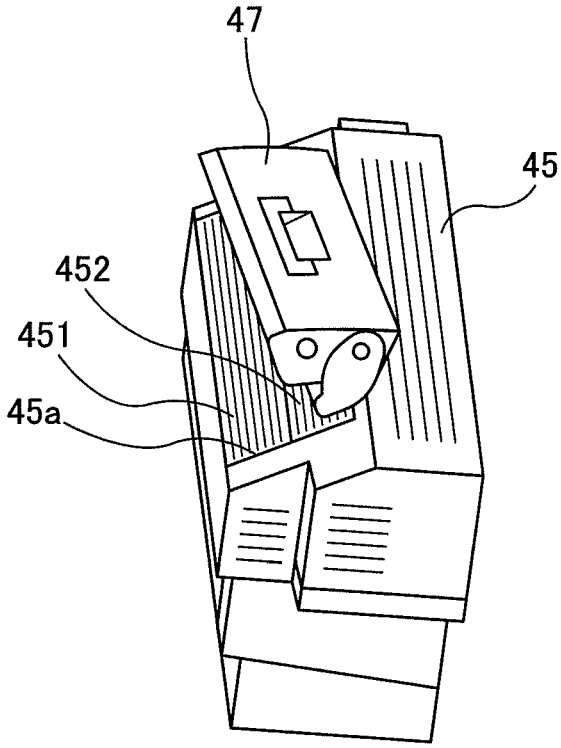
FIG. 6 is a perspective view illustrating the fixing device from which the cleaning device has been removed.

FIGS. 4, 5, and 6 are views for explaining removal of the cleaning device of the fixing device illustrated in FIG. 2. In FIG. 4, the fixing device 40 to which the cleaning device 47 is attached is illustrated. In FIG. 5, the fixing device 40 from which the cleaning device 47 is being removed is illustrated. In FIG. 6, the fixing device from which the cleaning device 47 has been removed is illustrated.

The used cleaning device 47 is removed from an insertion opening 45*a* provided in the housing 45 to the outside of the fixing device 40 in an order illustrated in FIG. 4, FIG. 5, and FIG. 6. An unused new cleaning device 47 is inserted from the insertion opening 45*a* in an order illustrated in FIG. 6, FIG. 5, and FIG. 4.

As illustrated in FIG. 6, a pair of tabular door members 451 and 452 that close the insertion opening 45*a* when the cleaning device 47 is removed from the fixing device 40 are provided in the housing 45. Each of the door members 451 and 452 includes, in particular, as illustrated in FIG. 2, rotating shafts 451*a* and 452*a* at edges of the insertion opening 45*a* and is supported by the housing 45 to be rotatable around the rotating shafts 451*a* and 452*a*. A force in a direction for closing the insertion opening 45*a* is applied to the door members 451 and 452 by a not-illustrated spring. Therefore, as illustrated in FIG. 6, in the state in which the cleaning device 47 is removed, the door members 451 and 452 close the insertion opening 45*a* and prevent intrusion of an unnecessary object. As illustrated in FIG. 5, when the cleaning device 47 is inserted, the door members 451 and 452 are pushed into the deep of the housing 45 by the cleaning device 47.

In FIG. 2, a state in which the cleaning device 47 is completely inserted is illustrated. When the cleaning device 47 is inserted, one door member 451 of the door members 451 and 452 moves to between the external heating roll 46 and the heating roll temperature sensor 441.

One door member 451 of the door members 451 and 452 is equivalent to an example of the tabular member in the present invention.

The temperature of the circumferential surface of the heating roll 41 is controlled based on temperature detected by the heating roll temperature sensor 441. Therefore, accuracy of temperature control depends on accuracy of the temperature detection by the heating roll temperature sensor 441. In a temperature sensor of a non-contact type, an error in a detection result may increase due to radiation heat or convection heat received from objects around the temperature sensor other than a target object. In particular, in structure in which the members including the heating roll temperature sensor 441 and the external heating roll 46 are arranged close to one another for a reduction in size of the device, if the heating roll temperature sensor 441 receives radiation heat or convection heat generated from a heat source other than the external heating roll 46 to be a temperature detection target, in particular, the external heating roll 46, an error in a detection result may increase and temperature control becomes inaccurate.

The arrangement of the heating roll temperature sensor 441 and the units around the heating roll temperature sensor 441 in the fixing device 40 according to this embodiment is explained with reference to FIG. 2.

The external heating roll 46, the cleaning device 47 and the heating roll temperature sensor 441 are arranged along a circumferential surface of the heating roll 41. In other words, the external heating roll 46, the cleaning device 47 and the heating roll temperature sensor 441 are aligned along a rotation direction of the heating roll 41. the cleaning device 47 is arranged between the external heating roll 46 and the heating roll temperature sensor 441. The heating roll temperature sensor 441 is arranged more downstream than a point right above a rotation center of the heating roll 41 and more upstream than the pressing roll 42. The external heating roll 46 is arranged more downstream than the pressing roll 42 and more upstream than the point right above the rotation center of the heating roll 41 in the rotation direction of the heating roll 41. A straight line P0 passing the external heating roll 46 illustrated in FIG. 2 is a line indicating a boundary between a front side T1 and a rear side T2 with respect to the heating roll temperature sensor 441 of the external heating roll 46. When the heating roll 41 is seen through from the heating roll temperature sensor 441, the front side T1 further on the heating roll temperature sensor 441 side than the straight line P0 in the circumference of the external heating roll 46 is not hidden by the external heating roll 46 and visible. The rear side T2, a side opposite to the front side T1 across the straight line P0, is hidden by the external heating roll 46. The cleaning device 47 is arranged in a position where the cleaning device 47 wipes the circumferential surface of the external heating roll 46 on the front side T1 of the external heating roll 46. The pressing roll 473 of the cleaning device 47 and the web 471 laid over the pressing roll 473 block a space between the external heating roll 46 and the heating roll temperature sensor 441.

One door member 451 of the pair of tabular door members 451 and 452 is located between the external heating roll 46 and the heating roll temperature sensor 441 in the state in which the cleaning device 47 is attached to the fixing device 40.

Therefore, radiation heat generated from the external heating roll 46 and transmitted toward the heating roll temperature sensor 441 is blocked by the web 471 of the cleaning device 47 and further blocked by the door member 451. Therefore, an error in the temperature detection of the heating roll temperature sensor 441 due to the radiation heat from the external heating roll 46 is suppressed.

In FIG. 2, concerning the external heating roll 46, a straight line P2 passing both the contact position M where the external heating roll 46 is in contact with the heating roll 41 and the rotation center 46*a* of the external heating roll 46 is illustrated. The heating roll temperature sensor 441 is arranged in a region S further on a downstream side in movement in the contact position M on the circumferential surface of the external heating roll 46 than the straight line P2.

The external heating roll 46 emits radiation heat from the circumferential surface. However, the heat is deprived by the heating roll 41 in the contact position M where the external heating roll 46 is in contact with the heating roll 41. Therefore, in the region S, the external heating roll 46 has temperature lower than the temperature in a region on the opposite side across the straight line P2 and has a smaller amount of radiation heat than the heat in the region. Therefore, in the heating roll temperature sensor 441 arranged in the region S, an amount of the radiation heat received from the external heating roll 46 is further suppressed.

In FIG. 2, a vertical line P1 extending straight upward from the rotation center 41*a* of the heating roll 41 is illustrated. The external heating roll 46 and the heating roll temperature sensor 441 are in contact with the heating roll 41 in a position avoiding a position right above the rotation center 41*a*, i.e., a position avoiding the vertical line P1. The external heating roll 46 is in contact with the heating roll 41 in a position further on an upstream side in the movement of the circumferential surface of the heating roll 41 than the position right above the rotation center 41*a*. The heating roll temperature sensor 441 is opposed to the circumferential surface of the heating roll 41 in a position further on the downstream side in the movement of the circumferential surface of the heating roll 41 than the position right above the rotation center 41*a*.

Since the external heating roll 46 warms the air present near the external heating roll 46 itself, convection of heat by the external heating roll 46 occurs. The air by the convection moves in a direction rising from the vicinity of the external heating roll 46. The heating roll temperature sensor 441 and the external heating roll 46 are arranged on both sides across the vertical line P1. Therefore, the heat by the convection is prevented from flowing beyond the position right above the rotation center 41*a* in the external heating roll 46 and reaching the heating roll temperature sensor 441.

The convection heat is also blocked from flowing to the heating roll temperature sensor 441 by the door member 451 arranged between the external heating roll 46 and the heating roll temperature sensor 441. Therefore, an error in temperature detection due to the convection heat from the heating roll 41 in the heating roll temperature sensor 441 is suppressed.

A second embodiment of the present invention will be explained. In the following explanation of the second embodiment, components same as the components in the embodiment explained above are denoted by the same reference numerals and signs. Differences from the embodiment described above are explained.

Figure 7:
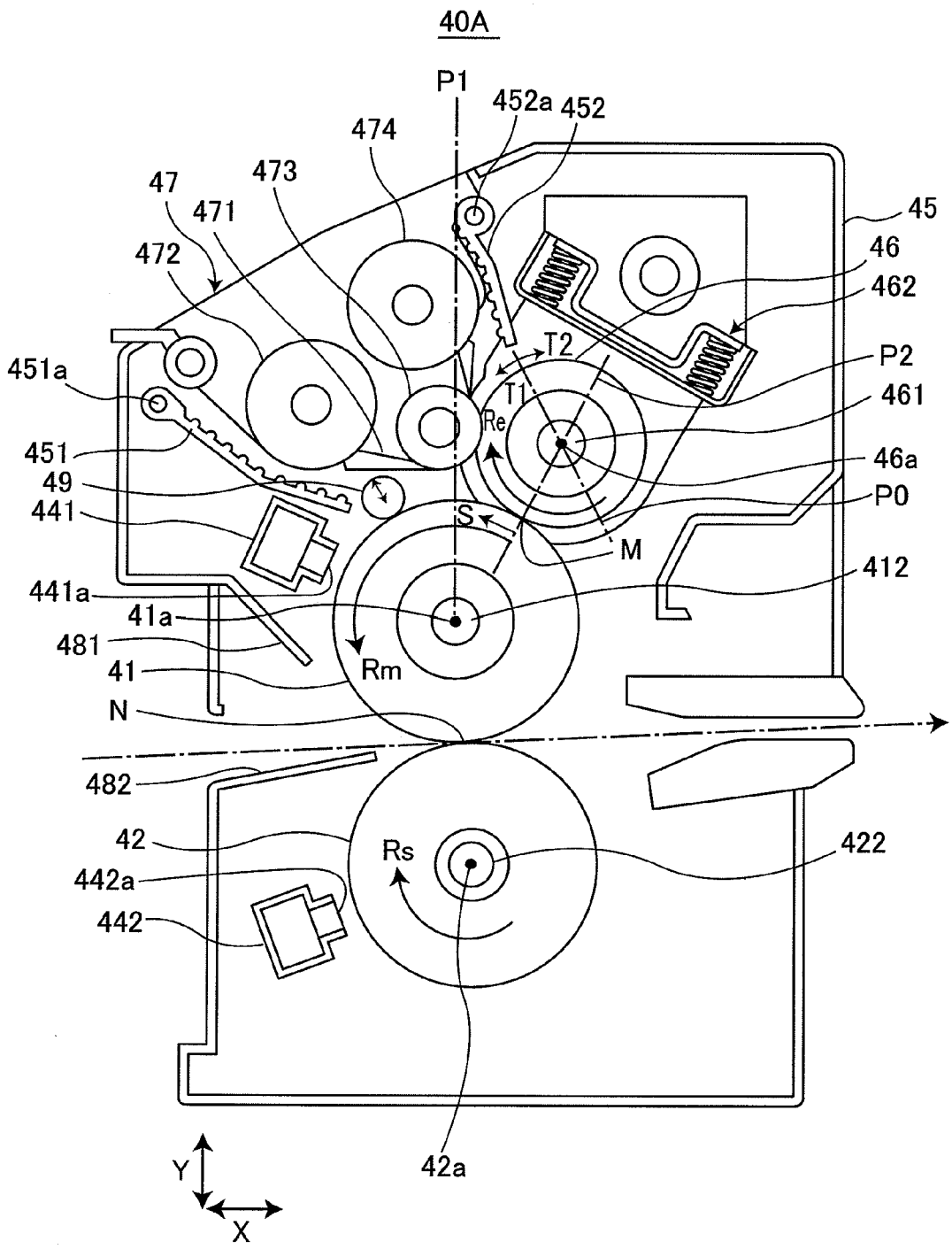
FIG. 7 is a longitudinal sectional view illustrating an internal configuration of a fixing device according to a second embodiment of the present invention.

FIG. 7 is a longitudinal sectional view of an internal configuration of a fixing device according to the second embodiment of the present invention.

A fixing device 40A according to the second embodiment is different from the first embodiment in that a refresh roll 49 in contact with the circumferential surface of the heating roll 41 is provided inside the fixing device 40A.

The refresh roll 49 is a bar-like member of metal extending along the heating roll 41. The refresh roll 49 is movably arranged between a position where the refresh roll 49 is in contact with the heating roll 41 and a position where the refresh roll 49 is in non-contact with the heating roll 41. The refresh roll 49 is periodically moved to the contact position by a not-illustrated contact mechanism controlled by the control unit 1A. As illustrated in FIG. 2, when the refresh roll 49 comes into contact with the heating roll 41, since the refresh roll 49 polishes the circumferential surface of the heating roll 41, a scratch produced on the circumferential surface of the heating roll 41 is hidden and the circumferential surface is smoothened. Therefore, disturbance of an image due to the scratch of the heating roll 41 is reduced. The refresh roll 49 is equivalent to an example of the polishing member in the present invention.

In the fixing device 40A according to the second embodiment, the refresh roll 49 is in contact with the circumferential surface of the heating roll 41 between the external heating roll 46 and the heating roll temperature sensor 441. Therefore, radiation heat from the external heating roll 46 is blocked by the refresh roll 49. Therefore, an error in temperature detection due to the radiation heat from the external heating roll 46 in the heating roll temperature sensor 441 is suppressed.

In the embodiments, the external heating roll is explained as an example of the heating device in the present invention. However, the heating device in the present invention is not limited to this and may be, for example, in a belt-like shape.

In the embodiments, the color copying machine is explained as an example of the image forming apparatus. However, the image forming apparatus in the present invention is not limited to this and may be, for example, a monochrome copying machine, a printer, or a facsimile.

In the embodiment, the sheet made of paper is explained as an example of the recording medium in the present invention. However, the recording medium in the present invention is not limited to this and may be, for example, a sheet made of resin.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first rotating member that rotates;

a second rotating member that extends side by side with the first rotating member, sandwiches a recording medium on which a toner image is formed between the second rotating member and the first rotating member, rotates together with the first rotating member, and heats the recording medium to fix the toner image on the recording medium;

a heating device whose circumferential surface circularly moves while contacting an external circumferential surface of the second rotating member, the heating device heating the second rotating member;

a temperature detecting device that is disposed to face the external circumferential surface of the second rotating member without contacting the external circumferential surface and detects a temperature of the external circumferential surface; and a cleaning device that cleans the circumferential surface of the heating device, and is disposed between the heating device and the temperature detecting device, wherein the heating device is disposed upstream of the cleaning device, which is disposed upstream of the temperature detecting device.

2. The fixing device according to claim 1, wherein the heating device is a rotating member that rotates around a rotation center line so that a circumferential surface of the heating device circularly moves, the temperature detecting device is disposed more downstream in a rotating direction of the second rotating member than a position where the heating device contacts the second rotating member, and the cleaning device is disposed between the heating device and the temperature detecting device in the rotating direction.

3. The fixing device according to claim 1, wherein the heating device is in contact with the external circumferential surface of the second rotating member in a first position avoiding a position right above the rotation center line of the second rotating member, the temperature detecting device is disposed more downstream than a point right above a rotation center of the second rotating member and more upstream than the first rotating member, and the heating device is disposed more downstream than the first rotating member and more upstream than the point right above the rotation center of the second rotating member in a rotating direction of the second rotating member.

4. The fixing device according to claim 1, wherein the cleaning device is arranged detachably attachable to the fixing device, and the fixing device further comprises:

a housing that houses the second rotating member, the heating device, and the temperature detector and has an insertion opening through which the cleaning device is inserted; and a plate member that has a rotating shaft, closes the insertion opening when the cleaning device is removed from the fixing device, and is located between a part of the heating device and a part of the temperature detecting device when the cleaning device is inserted from the insertion opening.

5. A fixing device comprising:

a first rotating member that rotates;

a second rotating member that extends side by side with the first rotating member, sandwiches a recording medium on which a toner image is formed between the second rotating member and the first rotating member, rotates together with the first rotating member, and heats the recording medium to fix the toner image on the recording medium;

a heating device whose circumferential surface circularly moves while contacting an external circumferential surface of the second rotating member, the heating device heating the second rotating member;

a temperature detecting device that is disposed to face the external circumferential surface of the second rotating member without contacting the external circumferential surface and detects a temperature of the external circumferential surface;

a cleaning device that cleans the circumferential surface of the heating device, and is disposed between the heating device and the temperature detecting device; and a polishing member that is in contact with the external circumferential surface of the second rotating member between the heating device and the temperature detecting device and polishes the external circumferential surface, wherein the heating device is disposed upstream of the cleaning device, which is disposed upstream of the temperature detecting device.

6. An image forming apparatus comprising:

a toner image forming unit that forms a toner image on a recording medium;

a first rotating member that rotates;

a second rotating member that extends side by side with the first rotating member, sandwiches the recording medium on which the toner image is formed thereon by the toner image forming unit between the second rotating member and the first rotating member, rotates together with the first rotating member, and heats the recording medium to fix the toner image on the recording medium;

a heating device whose circumferential surface circularly moves while contacting an external circumferential surface of the second rotating member, the heating device heating the second rotating member;

a temperature detecting device that is disposed to face the external circumferential surface of the second rotating member without contacting the external circumferential surface and detects temperature of the external circumferential surface; and a cleaning device that cleans the circumferential surface of the heating device, and is disposed between the heating device and the temperature detecting device, wherein the heating device is disposed upstream of the cleaning device, which is disposed upstream of the temperature detecting device.

7. The image forming apparatus according to claim 6, wherein the heating device is a rotating member that rotates around a rotation center line so that a circumferential surface of the heating device circularly moves, the temperature detecting device is disposed more downstream in a rotating direction of the second rotating member than a position where the heating device contacts the second rotating member, and the cleaning device is disposed between the heating device and the temperature detecting device in the rotating direction.

8. The image forming apparatus according to claim 6, wherein the heating device is in contact with the external circumferential surface of the second rotating member in a first position avoiding a position right above the rotation center line of the second rotating member, and the temperature detecting device is disposed more downstream than a point right above a rotation center of the second rotating member and more upstream than the first rotating member, and the heating device is disposed more downstream than the first rotating member and more upstream than the point right above the rotation center of the second rotating member in a rotating direction of the second rotating member.

9. The image forming apparatus according to claim 6, wherein the cleaning device is arranged detachably attachable to the fixing device, and the fixing device further comprises:

a housing that houses the second rotating member, the heating device, and the temperature detector and has an insertion opening through which the cleaning device is inserted; and a plate member that has a rotating shaft, closes the insertion opening when the cleaning device is removed from the fixing device, and is located between a part of the heating device and a part of the temperature detecting device when the cleaning device is inserted from the insertion opening.

10. The image forming apparatus according to claim 6, further comprising a polishing member that is in contact with the external circumferential surface of the second rotating member between the heating device and the temperature detecting device and polishes the external circumferential surface.

11. The fixing device according to claim 5, wherein the polishing member is configured to smoothen the external circumferential surface of the second rotating member to hide scratches produced on the external circumferential surface.

* * * * *